US006095717A

United States Patent [19]

Kaldenberg et al.

[11] Patent Number: 6,095,717

[45] Date of Patent: Aug. 1, 2000

[54] COMPACTION WHEEL HAVING REPLACEABLE CLEATS

[75] Inventors: James Kaldenberg, Albia, Iowa; Kenneth H. Pratt, New Port Richey, Fla.

[73] Assignee: Al-jon, Ottumwa, Iowa

[21] Appl. No.: 09/298,164

[22] Filed: Apr. 23, 1999

[51] Int. Cl.[7] ..... E10C 19/26

[52] U.S. Cl. ..... 404/121; 404/124; 301/43; 301/44.1; 301/44.3; 172/122

[58] Field of Search ..... D15/20; 301/43, 301/44.1, 44.2, 44.3, 44.4, 47, 49, 50, 52; 172/536, 540, 547, 550, 554, 555, 556, 772.5, 464, 122; 180/20; 404/121, 122, 124

[56] References Cited

U.S. PATENT DOCUMENTS

| | | | |
|---|---|---|---|
| 1,702,617 | 2/1929 | Pfeifer | 301/50 |
| 2,146,235 | 2/1939 | Sisler | 301/50 |
| 3,687,023 | 8/1972 | Moser et al. . | |
| 3,718,170 | 2/1973 | Caron et al. . | |
| 3,724,342 | 4/1973 | Caron et al. . | |
| 3,822,957 | 7/1974 | Caron et al. . | |
| 3,922,106 | 11/1975 | Caron et al. . | |
| 4,066,375 | 1/1978 | Caron et al. . | |
| 4,074,942 | 2/1978 | Cochran . | |
| 4,278,368 | 7/1981 | Livesay . | |
| 4,750,792 | 6/1988 | Caron et al. . | |
| 4,759,638 | 7/1988 | McLaughlin | 301/43 |
| 4,865,400 | 9/1989 | Caron et al. . | |
| 4,919,566 | 4/1990 | Caron et al. . | |
| 5,217,321 | 6/1993 | Corcoran et al. . | |
| 5,217,322 | 6/1993 | Corcoran et al. . | |
| 5,795,097 | 8/1998 | Caron et al. | 404/121 |

*Primary Examiner*—James A. Lisehora
*Assistant Examiner*—Alexandra K. Pechhold
*Attorney, Agent, or Firm*—McAndrews, Held & Malloy, Ltd.

[57] ABSTRACT

A compaction wheel includes a rigid cylinder forming an outer rim. Cleats are removably mounted in cleat-receiving apertures formal on the outer rim. Each cleat has a face plate configured to engage against the outer surface of the cylinder, a working portion extending from the outer surface of the face plate, and a tongue extending from the inner surface of the face plate and being configured to extend through the tongue receiving apertures formed in the outer rim. The tongue includes an aperture positioned to be located radially inwardly of the outer rim when the cleat is mounted on the outer rim. Connection rods are configured to extend through the tongue apertures to secure the cleats to the outer rim. For this purpose, the wheel includes guide tubes that are mounted radially inwardly of the outer rim. Each guide tube is associated with a different one of the cleat-receiving apertures and extends laterally between the lateral outer face of the wheel in a location adjacent to the outer edge of an associated cleat-receiving aperture. Each guide tube is adapted to receive a connection rod and direct it through the tongue opening of a cleat mounted in the associated cleat-receiving aperture.

17 Claims, 2 Drawing Sheets

COMPACTION WHEEL HAVING REPLACEABLE CLEATS

CROSS-REFERENCE TO RELATED APPLICATIONS

Not applicable

STATEMENT REGARDING FEDERALLY SPONSORED RESEARCH OR DEVELOPMENT

Not Applicable.

BACKGROUND OF THE INVENTION

This invention relates generally to compaction wheels, and more particularly concerns a compaction wheel having readily replaceable cleats.

Compaction wheels used in landfill operations are equipped with cleats or feet for grinding and crushing materials to reduce the size and bulk of the material. In the past, compaction wheels have typically been built with one-piece cleats that are welded to the outer drum or rim of the compaction wheel, or by welding the base of a two-piece cleat to the drum and welding, bolting, or pinning a harder, more wear-resistant cap to the base.

With use, the cleats become worn and need to be replaced. Prior cleat designs suffer from several drawbacks in this respect. For example, with the prior designs it is necessary to first dig the mud and garbage of the exterior of the drum to permit removal of the welds, old pins or bolts. This is dirty and highly undesirable work. Moreover, in two-piece designs the pins or bolts are exposed to corrosive materials that can make them difficult to remove. Additionally, field replacement of the cleats typically requires that service vehicles carry expensive equipment such as air compressors, air hammers, sledge hammers, torches and welding machines.

BRIEF SUMMARY OF THE INVENTION

One object of the invention is to provide a compaction wheel having readily replaceable cleats.

Another object of the invention is to provide a compaction wheel where cleat attachment is located inside the wheel outer drum, away from wear and corrosive materials.

Yet another object of the invention is to provide a cleated compaction wheel wherein the cleats can be removed with hand tools.

An additional object of the invention is to provide a cleated compaction wheel that is simple and economical to manufacture.

One or more of the preceding objects, or one or more other objects that will become plain upon consideration of the present specification, are satisfied by the invention described herein.

One aspect of the invention, which satisfies one or more of the above objects, is a compaction wheel comprising a rigid outer cylinder forming an outer rim. The outer cylinder has an exterior surface, an interior surface, and a plurality of cleat-receiving apertures extending between the outer and inner surfaces. A plurality of cleats are removably mounted on the outer surface of the cylinder. Each cleat has a tongue insertable through one of the cleat-receiving apertures. The tongue includes an aperture that is located radially inwardly from the outer rim when the cleat is mounted in the cleat-receiving aperture. Connection rods are configured to extend through the tongue openings when the cleats are mounted in the cleat-receiving apertures to secure the cleats to the rim.

The connection rods are removable and insertable into the compaction wheel from one of the inner and outer lateral faces of the wheel. In this manner, the cleats are secured to the compaction wheel at a location inside the outer rim of the wheel, away from wear and corrosive materials.

According to a further aspect of the invention, the compaction wheel includes a plurality of guide tubes mounted radially inwardly of the outer rim. Each guide tube is associated with a different one of the cleat-receiving apertures and extends laterally between the outer lateral face of the wheel and a location adjacent to the edge of an associated cleat-receiving aperture. Each cleat tube is adapted to receive a connection rod and direct it through the tongue opening of a cleat mounted in the associated cleat-receiving aperture. The connection rods are held in place by retainer plates that are removably secure to the outer lateral face of the wheel.

The cleat-receiving apertures, and hence the cleats, may be arranged in a plurality of circumferential rows on the outer rim of the wheel. Preferably there are three circumferential rows of cleat-receiving apertures and the cleat-receiving apertures in adjacent rows are axially offset from one another by a predetermined amount.

DETAILED DESCRIPTION OF THE INVENTION

Figure 1:
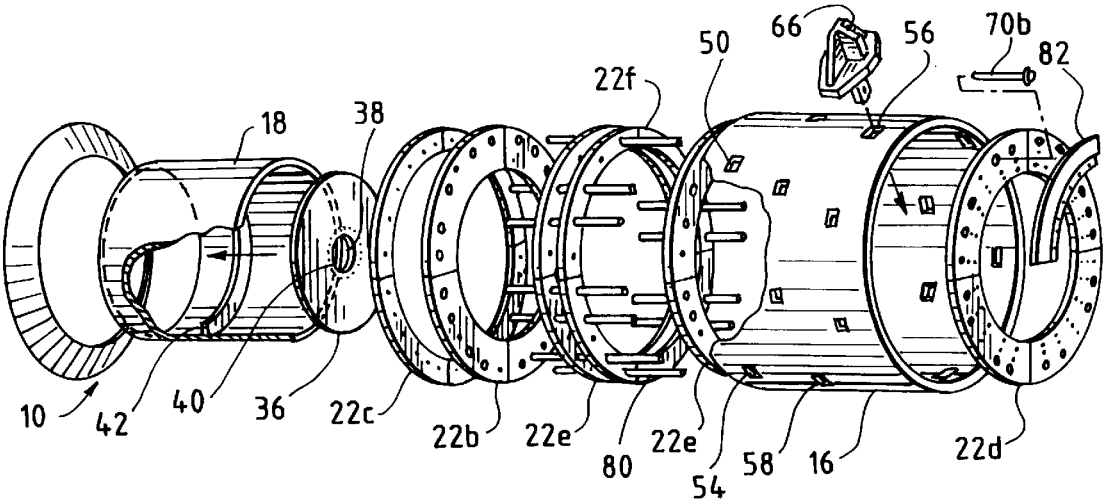
FIG. 1 is an exploded perspective view of a compaction wheel according to the present invention.
Figure 2:
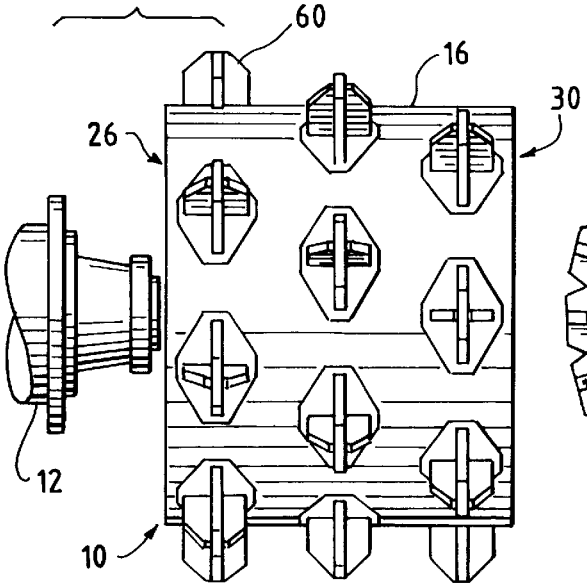
FIG. 2 is front elevation view of the compaction wheel of FIG. 1.

While the invention will be described in connection with one or more embodiments, it will be understood that the invention is not limited to those embodiments. On the contrary, the invention includes all alternatives, modifications, and equivalents as may be included within the spirit and scope of the appended claims.

Referring now to the drawings, a compaction wheel 10 mountable on the axle 12 of a vehicle (not shown) such as an end loader. The compaction wheel 10 includes a rigid outer cylinder or drum forming an outer rim 16. An inner rigid cylinder is coaxially secured within the outer rim 16 and defines the inner rim 18 of the wheel 10. A plurality of annular rings 22*a*–*f* (also referred to herein as cleat rings) are mounted between the outer and inner rims 16, 18. In particular, as can best be seen in FIG. 5, a first set 24 of annular rings 22*a*, 22*b* is positioned adjacent the inner lateral face 26 of the wheel 10. A second set 28 of the annular rings 22*c*, 22*d* is positioned adjacent the outer lateral face 30 of the wheel 10. A third set 32 of the annular rings 22*e*, 22*f* is positioned midway between the inner and outer lateral faces 26, 30 of the wheel 10. Each annular ring 22 is preferably formed of four arcuate members that are joined together by welding, for example.

The rings 22 are in turn slid onto the periphery of the inner rim 18 and affixed thereto, e.g., by welding. The outer rim 16 is subsequently slid onto the composite assembly and joined thereto by welding the outer rim 16 to the annular rings 22.

A wheel disk 36 is mounted within the inner rim 18 and defines a central opening 38 for receiving the axle 12 of the vehicle. A plurality of lug bolt openings 40 are spaced around the axle opening 38 and are positioned to align with and receive the lug bolts (not shown) carried by the axle 12. As will be appreciated, lug nuts are threaded onto the lug bolts to secure the wheel 10 to the axle 12. An annular stiffening ring 42 is secured within the inner rim 18, adjacent the wheel disk 36 to add structural rigidity to the wheel 10.

The outer rim 16 has a radial outer surface 46, a radial inner surface 48, and a plurality of cleat-receiving apertures 50 extending between the inner and outer surfaces. In particular, the wheel 10 includes three sets of apertures arranged in circumferential rows on the outer rim 16. A first or inner row 54 of apertures aligns with the gap 55 between the annular rings 22*a*, 22*b* in the first set 24 of annular rings. A second or outer row 56 of the apertures aligns with the gap 57 between the annular rings 22*c*, 22*d* in the second (outer) set 28 of annular rings 22. A third or middle set 58 of the apertures 50 aligns with the gap 59 between the rings 22*e*, 22*f* of the third (middle) set 32 of annular rings. The apertures in a given set of apertures are axially spaced from one another by a predetermined amount and preferably by 45 axially degrees. Moreover, the apertures in adjacent sets or rows are axially offset from one another by a predetermined amount, and preferably by 15°.

Cleats 60 are removably mounted on the outer surface 46 of the outer rim 16. Each cleat includes a face plate 62 configured to engage against the outer surface 46 of the outer rim 16. A working portion or cap 64 of the cleat extends from the outer surface of the faceplate 62. A tongue 66 extends from the inner surface of the faceplate 62 and is configured to extend through the apertures 50 in the outer rim 16. The annular rings in a given pair are spaced apart by a distance approximately equal to the width of the cleat tongue. Hence the annular rings laterally support the cleat tongue when the cleat is installed on the wheel. The tongue 66 includes an aperture 68 that is positioned to be located radially inwardly from the outer rim 16 when the cleat 60 is mounted on the wheel 10.

Connection rods 70*a–c*, are configured to be inserted through the tongue openings 68 to secure the cleats 60 to the wheel 10. In particular, long connection rods 70*a* are used to secure cleats within the first (inner) row 54 of apertures 50. Short connection rods 70*b* are used to secure cleats 60 within the second (outer) row 56 of apertures 50. And, medium length connection rods 70*c* are used to secure cleats 60 within the third (middle) row 58 of apertures 50.

Figure 3:
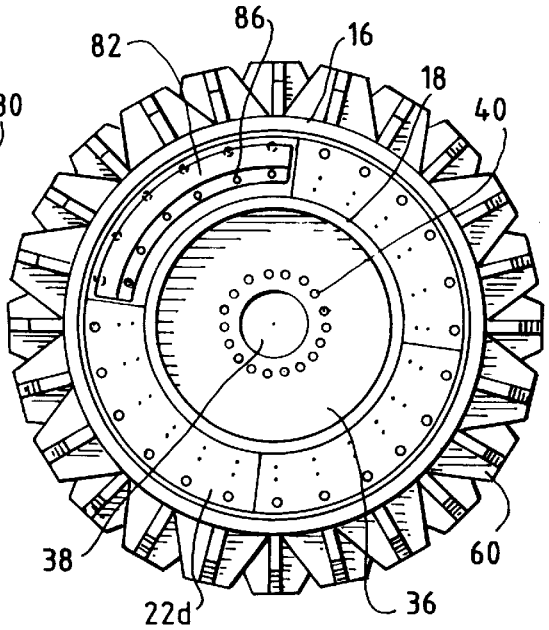
FIG. 3 is a side elevation view of the compaction wheel of FIG. 1.

The wheel 10 includes a plurality of guide tubes 80 secured between the outer and inner rims 16, 18. Each guide tube 80 is associated with a different one of the cleat-receiving apertures 50 and extends laterally between the outer lateral face 30 of the wheel and a location adjacent to the outer edge of an associated cleat-receiving aperture. The guide tubes are adapted to slidably receive a connection rod 70*a–c* and direct it through the tongue opening 68 of a cleat 60 mounted in the associated cleat-receiving aperture 50, thereby securing the cleat 60 to the outer rim 16. The connection rods 70 are held in place by retainer abutments 82 that bolt onto the outer face of the wheel 10. Preferably, there are four (4) retainer abutments 82 (one shown in FIGS. 1 and 3). Each of the retainer abutments 82 spans 90° around the outer face of the wheel 10. Each abutment 82 has a lower leg 84 which abuts against the outermost annular ring 22*d* and is secured thereto by a threaded fastener 86, such as a bolt. Hence, the abutments 82 can easily be installed and removed with simple hand tools. An upper leg 88 of the abutment 82 is laterally offset outwardly from the lower leg 84. The upper leg 88 overlies the connection rods 70 to secure them in place in the wheel 10.

Figure 4:
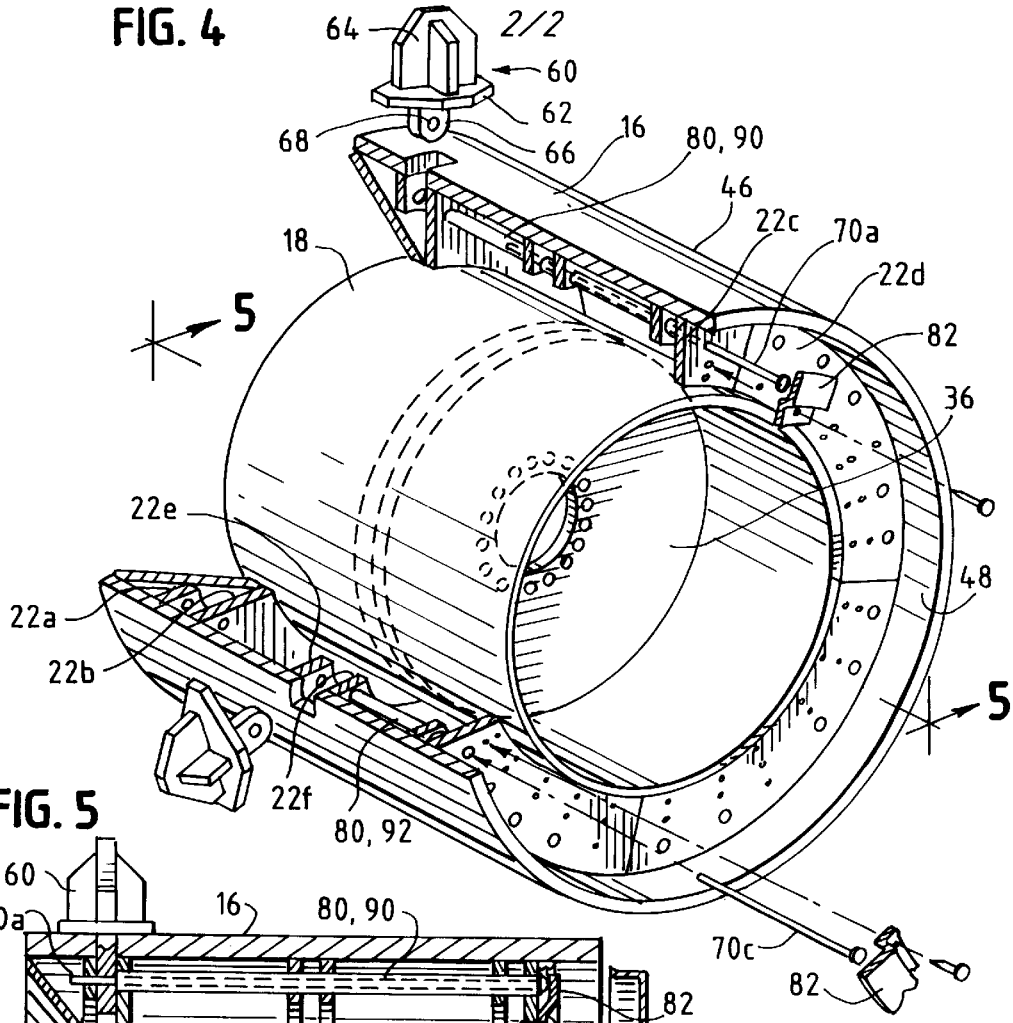
FIG. 4 is cut away perspective view of the compaction wheel of FIG. 1.
Figure 5:
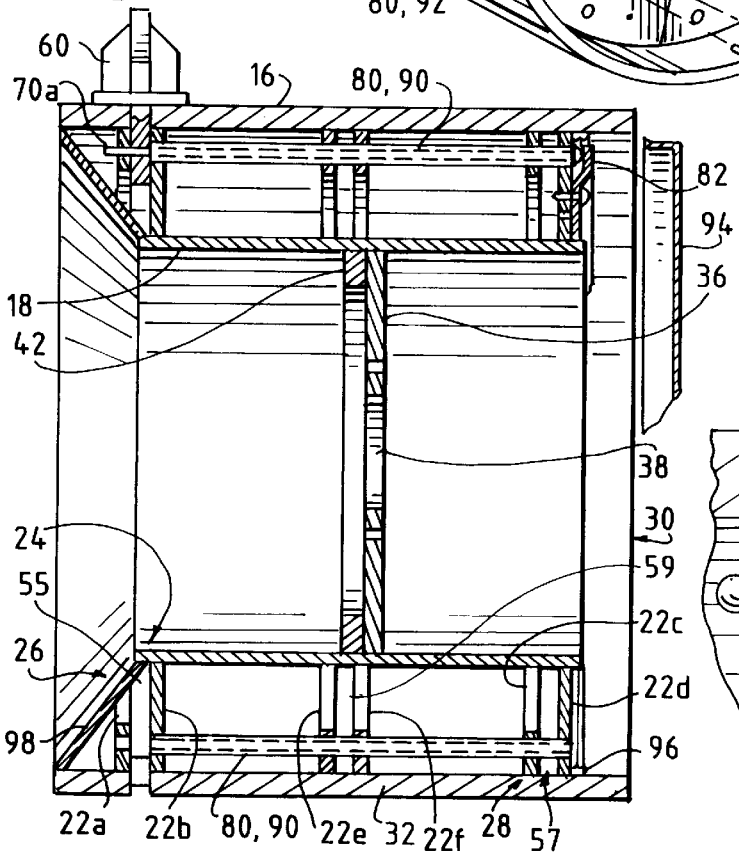
FIG. 5 is a cross-sectional view along line 5—5 of FIG. 4.
Figure 6:
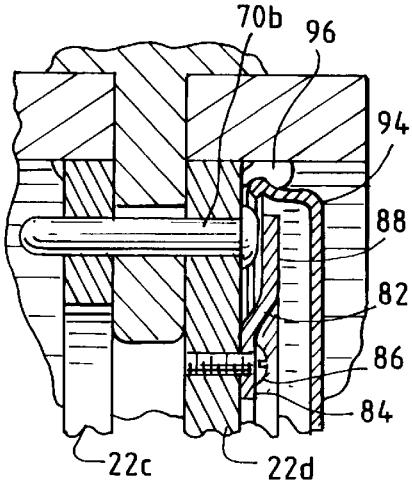
FIG. 6 is a partial cross-sectional view of the connection between a cleat and a connection rod in accordance with certain aspects of the present invention.

As can best be seen in FIGS. 4 and 5, the guide tubes come in two lengths, namely a plurality of first, relatively long guide tube 90 (FIG. 5) and a plurality of second, shorter guide tubes 92 (FIG. 4). Each of the first guide tubes 90 extends laterally across the wheel from the outer lateral face 30 to a location adjacent the outer edge of the associated cleat opening in the first (inner) row 54 of cleat openings. Each of the second, shorter guide tubes 92 extends between the outer lateral face 30 of the wheel 10 and the associated cleat opening in the third (middle) row 58 of cleat openings. As can be seen in FIG. 6, no guide tubes are used for the cleat openings in the second (outer) row 56 of cleat openings 50.

Referring to FIGS. 5 and 6, the wheel may include a hubcap 94 that is mountable in the outer periphery of the wheel 10. For this purpose, a hubcap stop 96 is fixed to the inner surface of the outer rim 16, adjacent the outer edge of the outer most annular ring 22*d* (see FIG. 6). The hubcap 94 is configured to snap into an annular groove formed in the hubcap stop 96. The wheel may also include an inner faceplate 98 to prevent debris from entering the gap between the inner and outer rims 18, 16.

In operation, cleats are replaced by initially removing the hubcap 94. This is accomplished by wedging a pry bar between the outer rim 16 and the hubcap 94, and prying the hubcap from the hubcap stop 96. The appropriate retainer abutment 82 is then removed by unthreading the fasteners 86 from the outer most annular ring. The wheel 10 utilizes four retained rebutments 82, each one spanning a 90° arch of the wheel. Therefore, it is only necessary to remove the retainer abutment that aligns with the cleat to be replaced. Once the retainer abutment 82 has been removed, the connection rod 70 associated with the cleat 60 to be replaced is slid outwardly until it disengages from the tongue 66 of the cleat. The cleat 60 is then removed and a new cleat is inserted into the cleat opening 50 in the outer rim 16. The connection pin 70 is then slid back into the wheel and through the tongue opening 68, thereby locking the cleat 60 into the wheel 10. The retainer abutment 82 is then reinstalled on the wheel, and the hubcap 94 is snapped back into place. This entire operation can be accomplished with hand tools such as wrenches, hammers and pry bars. Locating the cleat attachment inside the outer rim reduces wear and exposure of the connection elements to corrosive materials. This makes it easier and cleaner to replace cleats in the field, thereby reducing the time that the vehicle is out of service.

What is claimed is:

1. A compaction wheel mountable upon the axle of a vehicle, comprising:

a rigid cylinder forming an outer rim, the cylinder having an exterior surface, an interior surface, and a plurality of cleat-receiving apertures extending between the outer and inner surfaces;

a plurality of cleats removably mounted on the outer surface of the outer rim, each cleat having a tongue insertable through one of the cleat-receiving apertures, the tongue including an aperture positioned to be located radially inwardly from the outer rim when the cleat is mounted in a cleat-receiving aperture; and a plurality of connection rods, each rod being configured to extend through the opening in the tongue of one of the cleats when the cleat is mounted in the cleat-receiving aperture, thereby securing the cleat to the outer rim.

2. A compaction wheel as set forth in claim 1, wherein each cleat further includes a working portion and a face plate configured to engage against the outer surface of the outer rim, the working portion extending from the outer surface of the face plate and the tongue extending from the inner surface of the face plate.

3. A compaction wheel as set forth in claim 1, further comprising means for releasably securing the connection rods to the wheel.

4. A compaction wheel as set forth in claim 3, wherein said securing means comprises at least one retainer plate securable to the lateral outer face of the wheel.

5. A compaction wheel as set forth in claim 1, wherein the cleat-receiving apertures are arranged in circumferential rows on the outer rim.

6. A compaction wheel as set forth in claim 5, wherein three circumferential rows of cleat-receiving apertures are provided and wherein the cleat-receiving apertures in adjacent rows are axially offset from one another by a predetermined amount.

7. A compaction wheel as set forth in claim 6, wherein the cleat-receiving apertures in adjacent rows are axially offset from one another by 15°.

8. A compaction wheel as set forth in claim 1, wherein the compaction wheel has an inner lateral face and an outer lateral face, and wherein the connection rods are removable and insertable into the compaction wheel from one of the inner and outer lateral faces.

9. A compaction wheel as set forth in claim 8, further comprising a plurality of guide tubes mounted radially inwardly of the outer rim, each guide tube being associated with a different one of cleat-receiving apertures and extending laterally between the outer lateral face of the wheel and a location adjacent to the outer edge of an associated cleat-receiving aperture, each guide tube being adapted to receive a connection rod and direct it through the tongue opening of a cleat mounted in the associated cleat-receiving aperture.

10. A compaction wheel as set forth on claim 1, further comprising:

an inner rigid cylinder coaxially secured within the outer rigid cylinder;

a wheel disk mounted within the inner drum and defining a central opening for receiving the axle of a vehicle;

a plurality of guide tubes mounted between the inner and outer drums, each of the guide tubes being associated with a different one of cleat-receiving apertures and extending laterally between a lateral outer face of the wheel and a location adjacent to the outer edge of an associated cleat-receiving aperture, each guide tube being adapted to receive a connection rod and direct it through the tongue opening of a cleat mounted in the associated cleat-receiving aperture.

11. A compaction wheel mountable upon the axle of a vehicle, comprising:

a rigid cylinder forming an outer rim, the cylinder having an exterior surface, an interior surface, and a plurality of cleat-receiving apertures extending between the outer and inner surfaces;

a plurality of cleats removably mounted on the outer surface of the cylinder, each cleat having a face plate configured to engage against the outer surface of the cylinder, a working portion extending from the outer surface of the face plate, and a tongue extending from the inner surface of the face plate and being configured to extend through the apertures formed in the cylinder, the tongue including an aperture positioned to be located radially inwardly from the outer rim when the cleat is mounted on the outer rim; and an inner drum coaxially secured within the outer drum;

a wheel disk mounted within the inner drum and defining a central opening for receiving the axle of a vehicle;

a plurality of connection rods; and a plurality of guide tubes secured between the inner and outer rims, each of the guide tubes being associated with a different one of cleat-receiving apertures and extending laterally between an outer lateral face of the wheel and a location adjacent to the outer edge of an associated cleat-receiving aperture, each guide tube being adapted to receive a connection rod and direct it through the tongue opening of a cleat mounted in the associated cleat-receiving aperture to secure the cleat to the outer rim.

12. A compaction wheel as set forth in claim 11, further comprising means for releasably securing the connection rods to the wheel.

13. A compaction wheel as set forth in claim 12, wherein said securing means comprises at least one retainer plate securable to the outer lateral face of the wheel.

14. A compaction wheel as set forth in claim 11, wherein the cleat-receiving apertures are arranged in circumferential rows on the outer rim.

15. A compaction wheel as set forth in claim 11, wherein three circumferential rows of cleat-receiving apertures are provided and wherein the cleat-receiving apertures in adjacent rows are axially offset from one another by a predetermined amount.

16. A compaction wheel as set forth in claim 11, wherein the cleat-receiving apertures in adjacent rows are axially offset from one another by 15°.

17. A compaction wheel as set forth in claim 11, wherein the wheel includes inner, middle and outer circumferential rows of cleat-receiving apertures, and wherein guide tubes are only associated with the apertures in the inner and middle rows of cleat-receiving apertures.

* * * * *